United States Patent [19]

Kaneko

[11] Patent Number: 4,627,325

[45] Date of Patent: Dec. 9, 1986

[54] TOUCH RESPONSE APPARATUS FOR ELECTRONIC MUSICAL APPARATUS

[75] Inventor: Youji Kaneko, Tachikawa, Japan

[73] Assignee: Casio Computer Co., Ltd., Tokyo, Japan

[21] Appl. No.: 700,628

[22] Filed: Feb. 12, 1985

Related U.S. Application Data

[62] Division of Ser. No. 512,143, Jul. 8, 1983, Pat. No. 4,535,669.

[30] Foreign Application Priority Data

Jul. 13, 1982 [JP] Japan ..... 57-120551
Jul. 13, 1982 [JP] Japan ..... 57-120552
Jul. 13, 1982 [JP] Japan ..... 57-120553

[51] Int. Cl.[4] ..... G10H 1/057

[52] U.S. Cl. ..... 84/1.26; 84/1.1; 84/1.13

[58] Field of Search ..... 84/1.09, 1.1, 1.13, 84/1.26, 1.27

[56] References Cited

U.S. PATENT DOCUMENTS

| | | | |
|---|---|---|---|
| 3,180,919 | 4/1965 | Stiefel | 84/1.26 |
| 3,247,306 | 4/1966 | Milho | 84/1.13 |
| 4,014,238 | 3/1977 | Southard | 84/1.13 |
| 4,033,219 | 7/1977 | Deutsch | 84/1.13 X |
| 4,067,253 | 1/1978 | Wheelwright et al. | 84/1.1 |
| 4,114,496 | 9/1978 | Deutsch | 84/1.1 |
| 4,119,006 | 10/1978 | Whitefield | 84/1.13 |
| 4,154,133 | 5/1979 | Kitawaga | 84/1.26 |
| 4,184,403 | 1/1980 | Whitefield | 84/1.26 X |
| 4,195,545 | 4/1980 | Nishimoto | 84/1.26 |
| 4,205,575 | 6/1980 | Hoskinson et al. | 84/1.26 X |
| 4,245,542 | 1/1981 | Woron | 84/1.26 |
| 4,418,601 | 12/1983 | Whitefield | 84/1.26 |
| 4,426,902 | 1/1984 | Okumura et al. | 84/1.1 |

*Primary Examiner*—Stanley J. Witkowski

*Attorney, Agent, or Firm*—Frishauf, Holtz, Goodman & Woodward

[57] ABSTRACT

A touch response apparatus for an electronic musical instrument wherein a nonlinear analog-to-digital conversion is effected using a single A/D converter in correspondence with a plurality of keys, and wherein touch data are proportional to the period of time and amplitude value of an envelope waveform.

7 Claims, 16 Drawing Figures

9
A/D
PLA
KEY ON SIGNAL
a
b
c
IN1
IN2
IN3
IN4
IN5
IN6
IN7
COM1
COM2
COM3
COM4
COM5
COM6
COM7
LSB
MSB
R61
R62
R51
R52
R41
R42
R31
R32
R21
R22
R11
R12
V
AMP
GA1
GA2
GA61
SC1
SC2
SC61
1-2
1-61
1-1
S1
S2
S3
Ro
Co
VE
KEY ASSIGNOR

Fig.5

| TWO-CONTACT TIME DIFFERENCE | V | BUFFER OUTPUT | TOUCH DATA a | b | c |
|---|---|---|---|---|---|
| $0 < t \leqq t_1$ | $V_1 \leqq V < V_E$ | 1 1 1 1 1 1 1 | 0 | 0 | 0 |
| $t_1 < t \leqq t_2$ | $V_2 \leqq V < V_1$ | 0 1 1 1 1 1 1 | 0 | 0 | 1 |
| $t_2 < t \leqq t_3$ | $V_3 \leqq V < V_2$ | 0 0 1 1 1 1 1 | 0 | 1 | 0 |
| $t_3 < t \leqq t_4$ | $V_4 \leqq V < V_3$ | 0 0 0 1 1 1 1 | 0 | 1 | 1 |
| $t_4 < t \leqq t_5$ | $V_5 \leqq V < V_4$ | 0 0 0 0 1 1 1 | 1 | 0 | 0 |
| $t_5 < t \leqq t_6$ | $V_6 \leqq V < V_5$ | 0 0 0 0 0 1 1 | 1 | 0 | 1 |
| $t_6 < t \leqq t_7$ | $V_7 \leqq V < V_6$ | 0 0 0 0 0 0 1 | 1 | 1 | 0 |
| $t_7 < t$ | $0 \leqq V < V_7$ | 0 0 0 0 0 0 0 | 1 | 1 | 1 |

Fig. 6

| TOUCH DATA | MAXIMUM ENVELOPE VALUE | | | | | | | | |
|---|---|---|---|---|---|---|---|---|---|
| a b c | 256 | 128 | 64 | 32 | 16 | 8 | 4 | 2 | 1 (DECIMAL) |
| 1 1 1 | 0 | 0 | 0 | 1 | 1 | 1 | 1 | 1 | 1 (63) |
| 1 1 0 | 0 | 0 | 1 | 1 | 1 | 1 | 1 | 1 | 1 (127) |
| 1 0 1 | 0 | 1 | 0 | 1 | 1 | 1 | 1 | 1 | 1 (191) |
| 1 0 0 | 0 | 1 | 1 | 1 | 1 | 1 | 1 | 1 | 1 (255) |
| 0 1 1 | 1 | 0 | 0 | 1 | 1 | 1 | 1 | 1 | 1 (319) |
| 0 1 0 | 1 | 0 | 1 | 1 | 1 | 1 | 1 | 1 | 1 (383) |
| 0 0 1 | 1 | 1 | 0 | 1 | 1 | 1 | 1 | 1 | 1 (447) |
| 0 0 0 | 1 | 1 | 1 | 1 | 1 | 1 | 1 | 1 | 1 (511) |

| TOUCH DATA a b c | TIMINGS AT WHICH NO CLOCK IS DELIVERED 000 | 001 | 010 | 011 | 100 | 101 | 110 | 111 |
|---|---|---|---|---|---|---|---|---|
| 1 1 1 | – | ○ | ○ | ○ | ○ | ○ | ○ | ○ |
| 1 1 0 | – | ○ | ○ | ○ | – | ○ | ○ | ○ |
| 1 0 1 | – | ○ | – | ○ | – | ○ | ○ | ○ |
| 1 0 0 | – | ○ | – | ○ | – | ○ | – | ○ |
| 0 1 1 | – | – | – | ○ | – | ○ | – | ○ |
| 0 1 0 | – | – | – | ○ | – | – | – | ○ |
| 0 0 1 | – | – | – | – | – | – | – | ○ |
| 0 0 0 | – | – | – | – | – | – | – | – |

THINNING-OUT COUNTER
OCTAL COUNTER BLOCK
PROGRAMABLE COUNTER BLOCK
HA-3
HA-2
HA-1
8bit Φ1
E
E0
E3
Reset
a
b
c

| OCTAL COUNTER OUTPUT 4 2 1 | TIMINGS AT WHICH NO CLOCK IS DELIVERED 000 001 010 011 100 101 110 111 |
|---|---|
| 0 0 0 | — — — — — — — — |
| 0 0 1 | — — — ○ — — — — |
| 0 1 0 | — ○ — — — ○ — — |
| 0 1 1 | — — ○ — — — ○ — |
| 1 0 0 | ○ — — ○ — — ○ — |
| 1 0 1 | ○ — ○ ○ — ○ — — |
| 1 1 0 | ○ ○ ○ — ○ ○ — — |
| 1 1 1 | ○ ○ ○ ○ ○ ○ ○ — |

TOUCH RESPONSE APPARATUS FOR ELECTRONIC MUSICAL APPARATUS

This is a division of application Ser. No. 512,143, filed July 8, 1983, now U.S. Pat. No. 4,535,669, issued Aug. 20, 1985.

BACKGROUND OF THE INVENTION

1. Field of the Invention

The present invention relates to a touch response apparatus for an electronic musical instrument having a keyboard, which serves to detect a touch status of the key of the electronic musical instrument and to cause the touch status of the detected key to be reflected in generating the musical sound. More particularly, it relates to a touch response apparatus which generates data for a touch control of the envelope waveform of a musical sound in digital fashion.

2. Description of the Prior Art

In electronic musical instruments, it is very difficult, because of the use of switching means, to delicately transmit the touch status of a key to a sound-producing member as in a piano. Accordingly, various contrivances are made in the vicinities of keys.

In order to obtain a touch-sensitive keyboard, conventional electronic musical instruments are furnished with the touch response function of controlling the volume and tone color of a musical sound to-be-generated by detecting the depression speed or the depression pressure of a key during a key depressing operation.

Such electronic musical instrument having the touch response function generates a key depression speed detecting signal representative of the key depression speed for controlling the tone color and sound volume, besides a key-on signal.

Various arrangements have been proposed in order to produce the key depression speed detecting signal. As an arrangement for detecting the touch status of a key, there has been known one in which the period of time from the starting of the depression of the key to the end thereof is measured by a counter circuit, and the count output of the counter circuit is delivered as the key depression speed detecting signal.

This arrangement facilitates fabrication of the circuit in the form of an integrated circuit. However, it has the disadvantage of a complicated structure because the measuring counter circuits must be provided for the respective keys.

There has also been known a touch response mechanism in which each key is provided with first and second switches, these first and second switches being successively turned "on" by the depression of the corresponding key, and the difference of the times when the "on" states of the switches have been detected is found and used to determine a key depression speed.

When such touch response detection speed is used, time errors are involved in the scanning which detects the time differences of the first and second switches for all the keys, e.g., 61 keys on a keyboard. When it is intended to enhance the detecting precision, there is the problem that the keyboard scanning time must be shortened.

As a method by which the envelope waveform of a musical sound is changed depending upon the depression speed of a key, there has been one which utilizes a time constant based on a resistor R and a capacitor C. A voltage corresponding to a touch, namely, a depression speed is generated by a touch detector, and using the signal, the envelope waveform is produced by the resistor R and the capacitor C. This method is still unsatisfactory as stated below. Since all processing including, e.g., multiplication are performed in analog fashion, a processing circuit requires a large number of elements. Further, since the envelope waveforms are determined by the CR time constants, it is impossible to produce any desired envelope waveform.

In another known method, the depression speed of a key is converted into a digital value, on the basis of which an envelope value is read out from an envelope memory storing envelope values in advance, so as to produce an envelope waveform. With this method, the read-out speed of data from the envelope memory and the address position to-be-read are changed in relation to the depression speed.

The address position of the memory related to the depression speed must be accessed, and this processing is complicated.

Further, the ear of man senses the magnitude of a sound as a logarithmic function and also the variation of the sound as the logarithmic function. It is accordingly desirable that a musical sound to be generated varies as an exponential function.

BRIEF SUMMARY OF THE INVENTION

The present invention has been made in order to solve the problems described above, and has for its object to provide a touch response apparatus for an electronic musical instrument which produces an envelope waveform corresponding to a key touch, digitally with a simple circuit arrangement and which varies the envelope waveform exponentially.

Another object of the present invention is to provide a touch response apparatus for an electronic musical instrument in which, when an analog voltage corresponding to the touch response of a key generated by the depressing operation of the key is converted into a digital value by analog-to-digital conversion means, touch control data of a required number of bits can be obtained at will by the use of a single nonlinear analog-to-digital converter circuit.

Still another object of the present invention is to provide a touch response apparatus for an electronic musical instrument which holds an output corresponding to the touch response of a key and can eliminate the deviation of operation times on a keyboard.

Yet another object of the present invention is to provide a touch response apparatus for an electronic musical instrument in which the amplitude and the period of time of an envelope waveform are proportional to touch data.

Yet another object of the present invention is to provide a touch response apparatus for an electronic musical instrument in which the amplitude value of an envelope waveform is proportional to touch data, while the period of time thereof is fixed irrespective of the touch data.

Further objects of the present invention will become apparent from the following detailed description taken with reference to the drawings.

BRIEF DESCRIPTION OF THE DRAWINGS

FIG. 5 indicates buffer data and touch response data values to be used for the explanation of FIGS. 3 and 4;

FIG. 6 indicates digital data values illustrative of the relationship of the touch response data and maximum envelope values;

DESCRIPTION OF THE PREFERRED EMBODIMENTS

Figure 1:
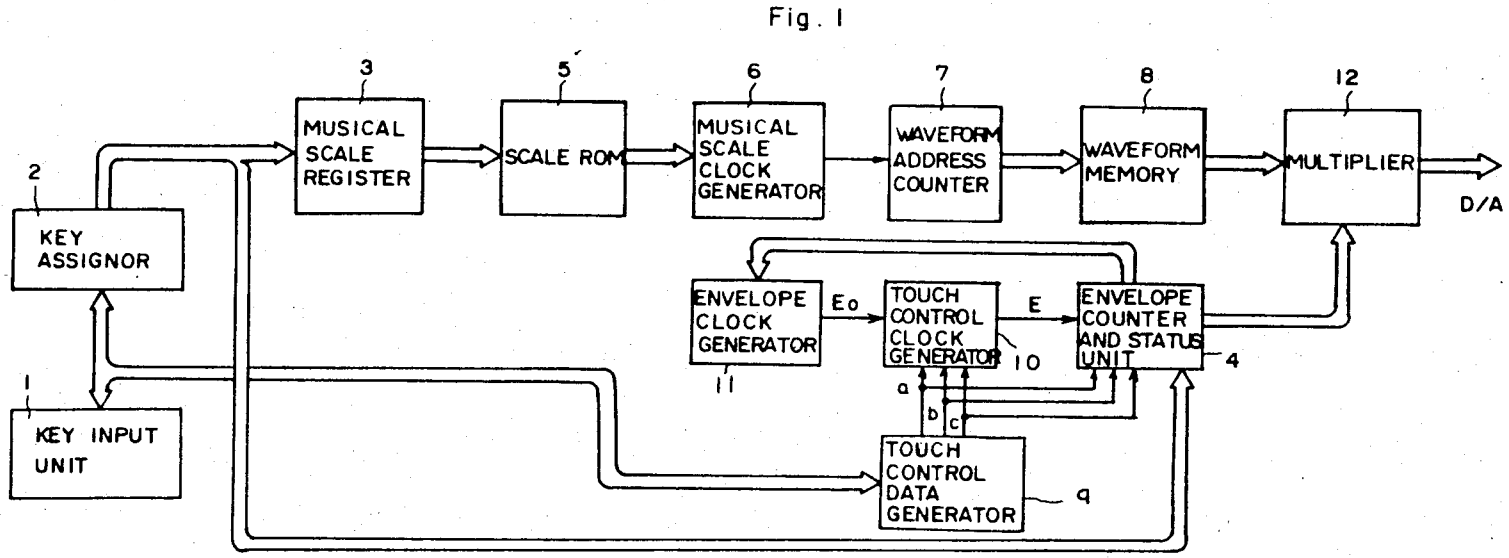
FIG. 1 is a block diagram of a touch response apparatus for an electronic musical instrument according to the present invention.

FIG. 1 shows a block diagram of a touch response apparatus for an electronic musical instrument according to the present invention. Numeral 1 designates a key input unit which comprises the plurality of keys of the electronic musical instrument, switches being disposed near the keys, etc. A depressed key is detected by a key assignor 2. Further, an analog voltage corresponding to a depression speed of the depressed key is also applied to a touch control data generator unit 9. In the following embodiments the depression speed of the key is caused to be reflected in the touch control and the depression pressure of the key may be caused to be reflected in the touch control. The key assignor 2 detects the depression state of the keyboard in the key input unit 1, and its output is applied to a musical scale register 3 and an envelope counter and status unit 4. The scale register 3 is a register in which the codes of musical sounds to be generated are stored. The output data of the scale register 3 is applied to a musical-scale read-only memory 5 (hereinbelow, abbreviated as "ROM") to access the address of the scale ROM 5. The scale ROM 5 stores therein clock information corresponding to the respective keys, and the data of the accessed address of the scale ROM 5 is delivered to a musical-scale clock generator unit 6. The scale clock generator unit 6 produces a scale clock which is to be generated by the data of the scale ROM 5, namely, the clock information corresponding to the key. This scale clock is outputted to a waveform address counter 7. The waveform address counter 7 counts the clock pulses generated by the scale clock generator unit 6. The count value increments each time the clock pulse is inputted. That is, the count value increases at a speed corresponding to the depressed key. The output of the waveform address counter 7 accesses the address of a waveform memory 8. Waveform data for wavelength of the musical sound to be generated is stored in the waveform memory 8, the output of which is digital data corresponding to the musical sound.

Meanwhile, the touch control data generator unit 9 is supplied with an analog voltage corresponding to a depression speed in the key input unit 1. Thus, it produces digital data of three bits a, b and c from the analog voltage which is proportional to the depression speed of the key. The digital data a, b and c from the touch control data generator unit 9 are inputted to a touch control clock generator unit 10 and the envelope counter and status unit 4.

The touch control clock generator unit 10 generates a clock E corresponding to the key depression speed, on the basis of a clock signal $E_0$ delivered from an envelope clock generator unit 11 and the 3-bit data a, b and c mentioned above. The envelope counter and status unit 4 generates envelope data by counting the clock pulses E. The output of the envelope counter and status unit 4 is applied to a multiplier unit 12, and also informs the envelope clock generator unit 11 of a status such as attack, decay or release.

The multiplier unit 12 multiplies the outputs of the envelope counter and status unit 4 and the waveform memory 8, and the resulting proudct is outputted to a digital-to-analog converter D/A (not shown in FIG. 1). The digital data produced by the multiplier unit 12 is the musical sound corresponding to the key, and the amplitude value thereof has a value corresponding to the depression speed. As a matter of course, therefore, the analog signal into which this digital signal is converted by the digital-toanalog converter D/A corresponds to the musical scale and musical sound corresponding to the depressed key, and it is a value corresponding to the touch response or the depression speed of the depressed key.

The system setup shown in FIG. 1 is adapted to simultaneously generate a plurality of sounds by a method of time-division processing.

Figure 2:
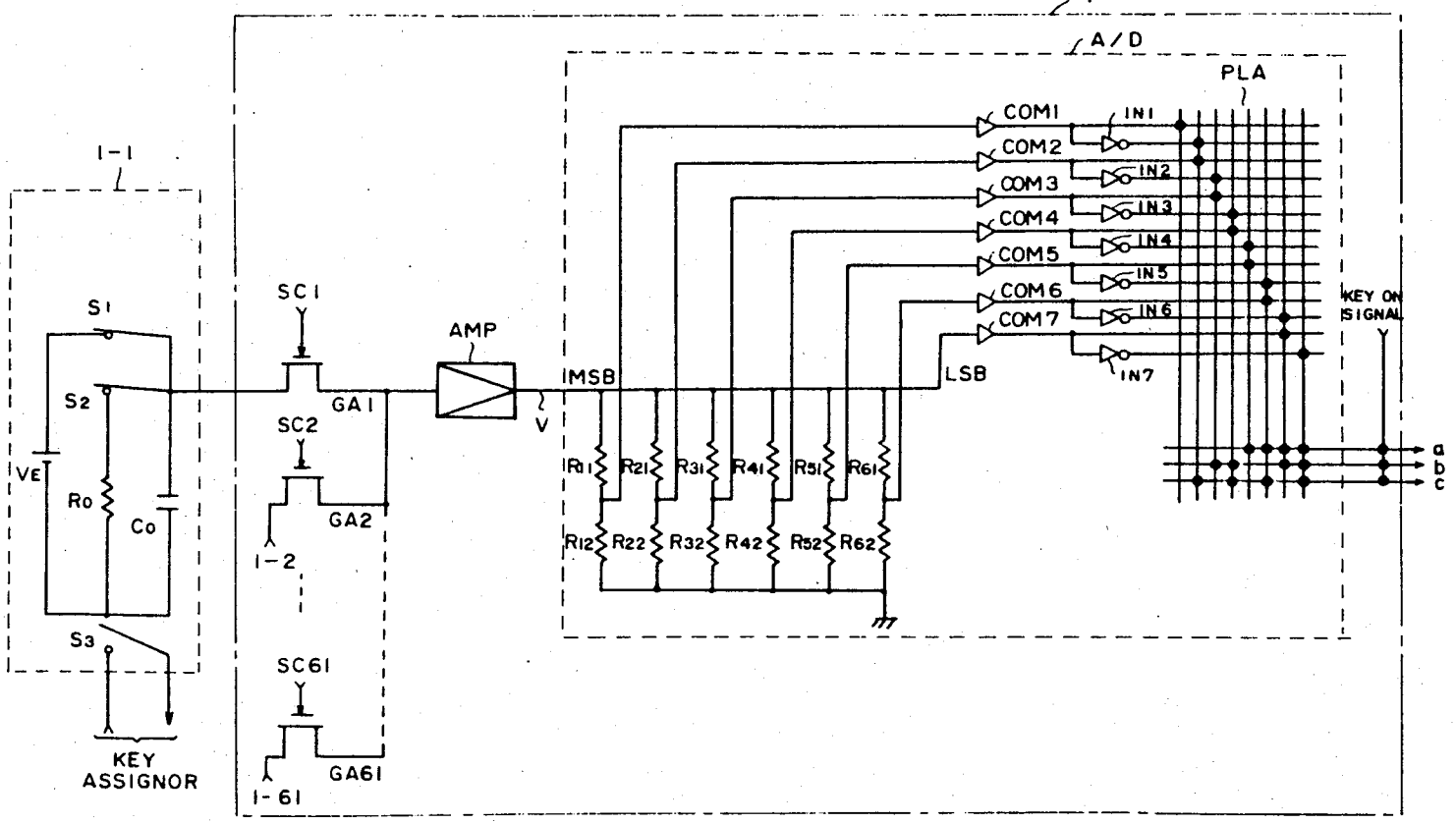
FIG. 2 is a circuit diagram of a key input unit and a touch control data generator unit shown in FIG. 1.

FIG. 2 is a circuit diagram showing the relationship between the touch control data generator unit 9 and the key input unit 1 illustrated in FIG. 1. Symbol 1-1 denotes a key touch detecting and holding circuit in the key input unit 1. The number of such key touch detecting and holding circuits corresponds to the number of keys in the keyboard, for example, 61 (sixty-one).

The key touch detecting and holding circuit 1-1 forms a charging circuit out of a capacitor $C_0$ which is connected in series with a D.C. power source $V_E$ through a first normally-closed switch $S_1$, while it forms a discharging circuit out of a second normally-closed switch $S_2$ and a resistor $R_0$ which are connected in parallel with the capacitor $C_0$. Shown by symbol $S_3$ is a third normally-open switch, which is closed by the depression of the corresponding key. Thus, the key assignor 2 is informed of the fact that the first key, e.g., in the key input unit 1 has been depressed.

When the first key is depressed by way of example, the first normally-closed switch $S_1$ is opened, and charges having been stored in the capacitor $C_0$ through the path of the D.C. power source $V_E \rightarrow$first switch $S_1$ are discharged to the resistor $R_0$ through the second normally-closed switch $S_2$. Subsequently, the second normally-closed switch $S_2$ is opened to stop the discharge. In this way, charges corresponding to the depression speed of the first key are held in the capacitor $C_0$.

When the particular one of the third switches $S_3$ arrayed in the shape of a matrix is subsequently closed, the key assignor 2 can find which key is depressed, and it applies a signal corresponding to the depressed key, namely, a signal SC1 in the present case to the gate of a field-effect transistor GA1 which is connected to the output end of the key touch detecting and holding circuit 1-1. Then, the field-effect transistor GAl (hereinbelow, termed "gate circuit") is turned "on", and a voltage corresponding to the charges stored in the capacitor $C_0$ is applied through an amplifier AMP to an analog-to-digital converter circuit A/D disposed at the succeeding stage. Gate circuits GA2, . . . and GA61 are wired similarly to the first gate circuit GA1 in correspondence with the respective key touch detecting and holding circuits 1-2 to 1-61, and their outputs are connected in common and applied to the amplifier AMP. In the embodiment, therefore, the single analog-to-digital converter circuit A/D suffices for the 61 keys.

The touch control data generator unit 9 is made up of the plurality of gate circuits GA1, GA2, . . . and GA61, the single amplifier AMP and the single analog-to-digital converter circuit A/D as indicated by a dot-and-dash line in FIG. 2. The analog-to-digital converter circuit A/D indicated by a broken line is constructed of a resistance network which divides the input voltage applied from the amplifier AMP. More specifically, six sets of resistors $R_{11}$ and $R_{12}$, $R_{21}$ and $R_{22}$, $R_{31}$ and $R_{32}$, $R_{41}$ and $R_{42}$, $R_{51}$ and $R_{52}$, and $R_{61}$ and $R_{62}$ connected in series to each other between the output line of the amplifier AMP and the ground point of the circuitry are connected in parallel to one another. The node of the first set of resistors $R_{11}$ and $R_{12}$ is connected to a first comparator COM1 so as to apply a divided voltage thereto. Likewise, the nodes of the second-sixth sets of resistors $R_{21}$ and $R_{22}$–$R_{61}$ and $R_{62}$ are respectively connected to second-sixth comparators COM2–COM6. Further, the data line voltage V of the amplifier AMP is applied to a seventh comparator COM7. That is, the A/D conversion is effected by utilizing whether or not the voltages divided by the resistance network exceed the reference voltages of the comparators COM1–COM7. The resistors $R_{11}$–$R_{62}$ described above have the following relationships.

Supposing the resistances of the resistors to be $R_{11}+R_{12}=R_{21}+R_{22}=R_{31}+R_{32}=\ldots=R_{61}+R_{62}=R$, the respective input voltages to the comparators COM1–COM7 become $(R_{12}/R)\cdot V$, $(R_{22}/R)\cdot V$, . . . , $(R_{62}/R)\cdot V$, and V where V denotes the output voltage of the amplifier AMP. When the resistances are selected to be $R_{12}<R_{22}<R_{32}<R_{42}<R_{52}<R_{62}$, outputs "0, 0, 1, 1, 1, 1, 1", for example, are obtained for a certain value of the AMP output voltage V. The output values are binary-coded by a programed logic array PLA so as to provide the digital data a, b and c.

Figure 3:
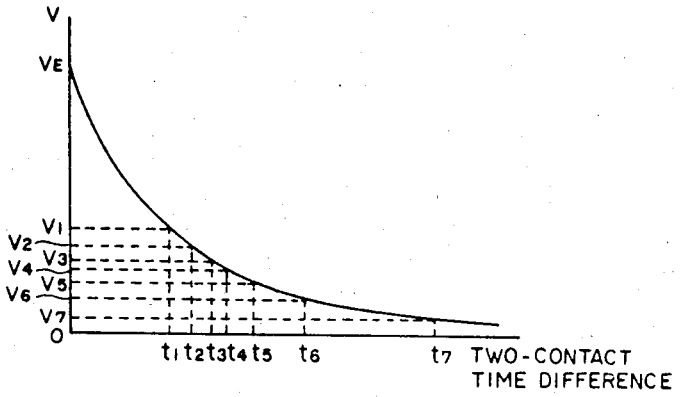
FIG. 3 is a graph showing the relationship of the output voltage and the two-contact time difference in a key touch detecting and holding circuit shown in FIG. 2.
Figure 4:
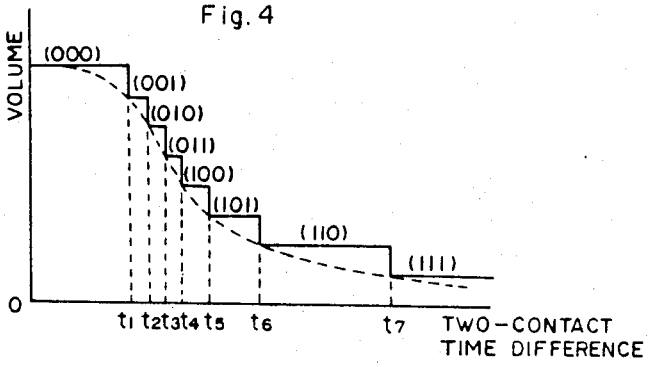
FIG. 4 is a graph of a steplike curve illustrative of the relationship of the two-contact time difference and the sound volume in the same.

FIG. 3 illustrates the relationship between the operating time differences of the first and second switches $S_1$ and $S_2$ shown in FIG. 2 and the discharge waveform of the voltage V held in the capacitor $C_0$. In FIG. 3, values 0, $t_1$, . . . and $t_7$ are taken on the axis of abscissas as the two-contact time differences of the first and second switches $S_1$ and $S_2$, while values 0, $V_7$, $V_6$, . . . $V_2$, $V_1$ and $V_E$ are taken on the axis of ordinates as the holding voltage of the capacitor $C_0$. As seen from the graph, the held capacitor voltage corresponding to a high depression speed and that corresponding to a low depression speed are scarcely different for the holding voltages $V_1$–$V_5$ at $t_1$–$t_5$. With the ordinary linear A/D conversion, therefore, the relationship between the two-contact time differences of keys, namely, the key depression speeds and the output sound volumes needs to be set as illustrated in FIG. 4. In this regard, a prior-art example generates an analog voltage corresponding to the depression speed of a key, applies the analog voltage to an A/D circuit, reads out touch response data by using the digital output of the A/D circuit as an address, applies the read-out data to a D/A circuit so as to obtain an analog signal, and controls a musical sound with this analog signal. Since the touch data is read out using the digital value as the address, a large number of circuits including a memory circuit etc. are required. The arrangement of the prior art has accordingly been complicated.

In the present invention, therefore, a nonlinear A/D conversion is effected by properly selecting the ratios of the resistances of the resistor network, whereby both the conversions are simultaneously performed without especially converting D/A output data into data for the sound volume control. To this end, the resistances of the resistors $R_{11}$–$R_{62}$ are set so that the relationship of FIG. 3 may become as follows:

$$V_1 = (R/R_{12})V_7$$
$$V_2 = (R/R_{22})V_7$$
$$\vdots$$
$$V_6 = (R/R_{62})V_7$$

Here, $V_7$ denotes a detection voltage or a reference voltage of the comparators COM1~COM7. Further, by selecting the values of the charging and discharging resistor $R_0$ and capacitor $C_0$ in FIG. 2, digital data as indicated in FIG. 5 are provided at the outputs of the resistor network (buffer outputs) for various conditions of the two-contact time difference t (key depression speed) and the held capacitor voltage V. By way of example, if the two-contact time difference is $0<t\leqq t_1$ and the AMP output V is $V_1\leqq V<V_E$ (refer to FIG. 3), digital data "1, 1, 1, 1, 1, 1, 1" will be provided in the direction from the most significant bit MSB to the least significant bit LSB of the resistor circuit network.

Regarding the digital data of the comparators COM1–COM7 as indicated in FIG. 5, these affirmative outputs and negative outputs obtained through inverters IN1–IN7 are applied to the programed logic array PLA having a matrix arrangement. A key-on signal is applied to a group of gates which pertain to three row lines intersecting the column lines of the matrix (in FIG. 2, mark ○ denotes an AND gate, and mark ◓ denotes a gate circuit such as FET). Thus, the case where the outputs of the comparators COM1–COM7 are "1, 1, 1, 1, 1, 1, 1" is brought into correspondence with the three bits of "0, 0, 0", and a case where they are "0, 0, 0, 0, 0, 0, 0" is brought into correspondence with the three bits of "1, 1, 1". The other cases are brought into correspondence with three bits as listed in FIG. 5. In this way, as the corresponding relationship between the two-contact time difference and the sound volume in FIG. 4, there are obtained steplike touch response data a, b and c which are close to an ideal curve indicated by a broken line. According to this construction, the sound volume can be reliably varied stepwise even with small speed differences.

The touch response data a, b and c described above are converted as indicated in FIG. 6. In terms of the maximum envelope values, the data "1, 1, 1" can be put into '63' as a decimal number, "1, 1, 0" into '127', "1, 0, 1" into '191', . . . and "0, 0, 0" into '511'.

As described above in detail, according to the touch control data generator unit 9 of the present invention, an analog voltage corresponding to the touch of a key is nonlinearly A/D-converted. Therefore, data thus obtained can be directly used as touch response data without employing any other conversion means, and a single A/D converter circuit having the smallest number of bits suffices for a plurality of keys. A touch response of high precision is attained even for the fast depression of a key, and no error arises even for the slow depression of a key.

Further, a touch signal is converted for each key, and the resulting signal is caused to wait, whereupon the latter signal can be fed into an LSI or the like along with a signal indicative of the "on" of the key. This brings forth the merit that a channel can be selected with only the key-on signal and that a conventional circuit can be used as it is.

Figure 7:
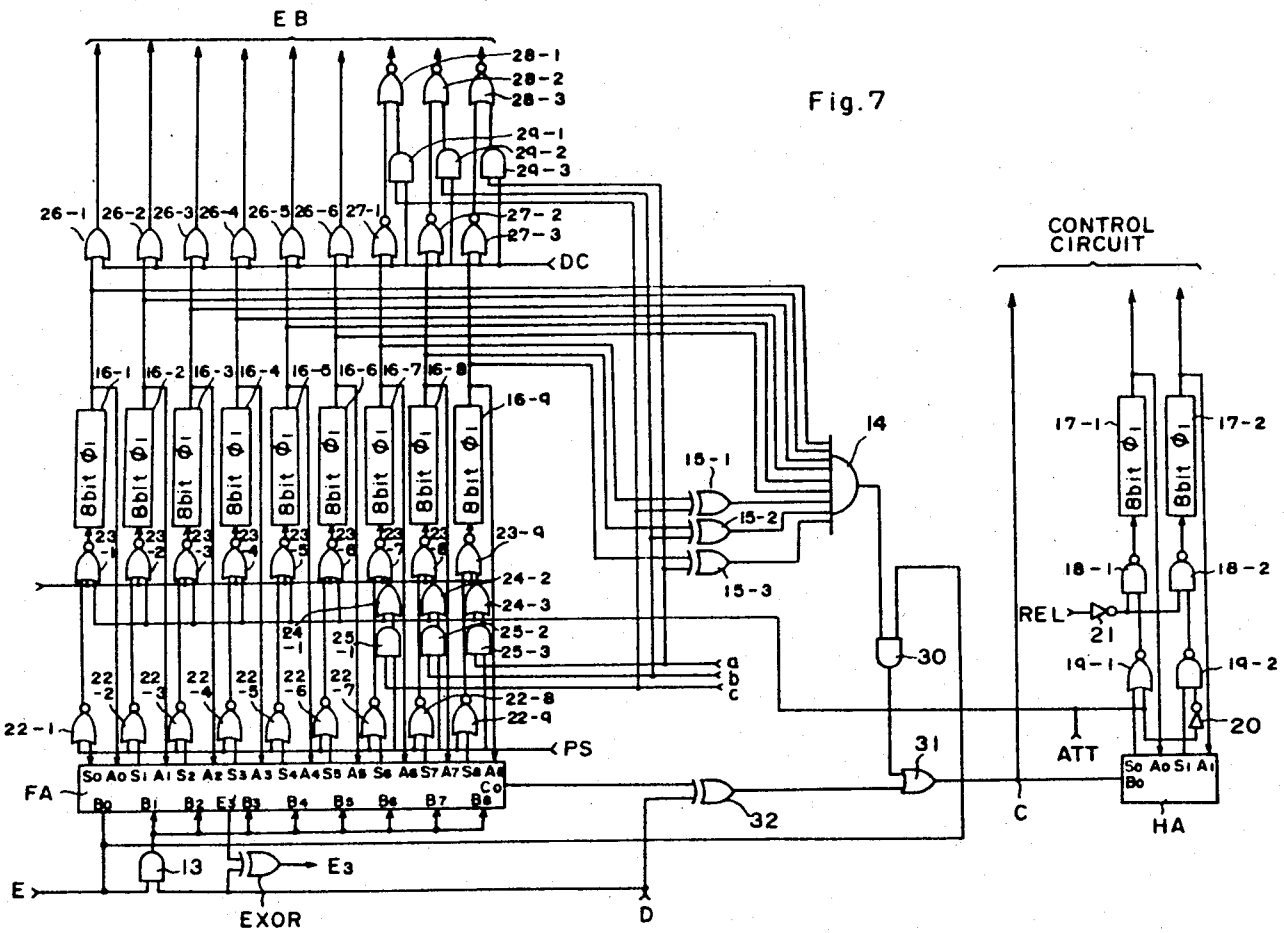
FIG. 7 is a circuit diagram of an envelope counter and status unit according to the present invention.

FIG. 7 corresponds to the envelope counter and status unit 4 in the system setup illustrated in FIG. 1.

The clock signal E produced by the touch control clock generator unit 10 is applied to the least significant bit $B_0$ of the addition input of a full adder FA, and to an AND gate 13. The output of the AND gate 13 is supplied to the addend input $B_1$ to $B_8$. In the status of attack, a low (L) level signal is inputted as a subtraction signal D as will be described later, so that the full adder FA operates similarly to an increment counter, namely, so that the addend input $B_1$ to $B_8$ of the full adder FA comes to a low level and the lower bit $B_0$ receives a clock signal E, thereby turning to a high level, resulting in that the full adder FA functions to add "1" to the augend input $A_0$ to $A_8$. In the status of release, a high (H) level is inputted as the subtraction signal D, so that the full adder FA operates similarly to a decrement counter with the H level as a carry output $C_0$, namely, so that all of the addend input $B_0$ to $B_8$ receive a high level, resulting in that the full adder FA causes the carry output $C_0$ to be in a high level and functions to subtract "1" from the augend input. The full adder FA also has the function of delivering a carry from its lower 3 bits, and the carry output $E_3'$ is passed through an exclusive OR gate EXOR to derive a signal $E_3$ therefrom. Though not shown in FIG. 1, this signal $E_3$ is inputted to the touch control clock generator unit 10. The input end of the exclusive OR gate EXOR other than that supplied with the carry output $E_3'$ receives the subtraction signal D. An AND gate 14 and exclusive OR gates 15-1 to 15-3 constitute a circuit which detects the maximum value of envelope data, and the inputs of which are outputs from shift registers 16-1 to 16-9 of eight bits. The upper 3 bits, namely, the outputs of the shift registers 16-9 to 16-7 and the touch data a–c are respectively supplied to the exclusive OR gates 15-3 to 15-1. When the respective data are not in accord, the outputs of the exclusive OR gates are high. Namely, the touch data a–c represent the inverted value of the upper 3 bits of the envelope data and when the maximum value (the reached value) of the envelope is coincident with the outputs of the shift registers 16-9 to 16-7, a H level signal is produced from the exclusive OR gates 15-1 to 15-3. When the lower data take a maximum value, i.e. the outputs of the shift registers 16-1 to 16-6 are high, and the output of the exclusive OR gates 15-1, 15-2, 15-3 are high, this is detected by AND gate 14.

In the relations between the touch data and the maximum values of the envelope listed in FIG. 6, the "H" level is indicated by "1", and the "L" level by "0". When all the touch data a, b and c are at the "H" level, the maximum envelope value is the decimal number 63, and when all the touch data are at the "L" level, the maximum value is the decimal number 511. As seen from the figure, data with the logic of the touch data a, b and c inverted correspond to the upper 3 bits of envelope data EB.

The 8-bit shift registers 16-1 to 16-9 are disposed so that the depression of a plurality of keys can be coped with, in other words, that up to eight sounds can be produced at the same time. The correspondence between the respective bits and the depressed keys is established by the key assignor 2. More specifically, the outputs of the 8-bit shift registers 16-1–16-9 are applied to the augend inputs $A_0$–$A_8$ of the full adder FA, and the sum outputs $S_0$–$S_8$ of the full adder FA are applied to the shift registers 16-1–16-9 through NOR gates 22-1–22-9 and 23-1–23-9, whereby a looped shift memory is constructed. The NOR gates 23-1–23-9 and OR gates 24-1–24-3 constitute a gate circuit which applies the "L" level to the shift registers 16-1–16-9 upon receiving an attack signal ATT and a control signal CON to be described later. The NOR gates 22-1–22-9 and AND gates 25-1–25-3 constitute a circuit which applies the maximum value when a preset signal has been received from a control circuit to be described later, that is, when the release status has been established. At this time, the touch data a, b and c are inverted, and the inverted data are inputted to the 8-bit shift registers 16-9–16-7 through the OR gates 24-3–24-1 as well as the NOR gates 23-9–23-7. In addition, the "H" level is inputted to all the 8-bit shift registers 16-6–16-1. This input condition is established by the basic clock $\phi 1$.

The outputs of the 8-bit shift registers 16-1–16-9 are applied to the circuit for detecting the required maximum value of the envelope data, as stated before, and are also delivered as the envelope data EB through OR gates 26-1–26-6 and NOR gates 27-1–27-3 as well as 28-1–28-3.

In the decay status, a decay signal DC from the control circuit is received and applied to the OR gates 26-1 to 26-6 and the NOR gates 27-1 to 27-3, whereupon all the lower 6 bits of the envelope data become the "H" level as far as the decay signal is in the "H" level, and the touch data c, b and a in the upper 3 bits are inverted through AND gates 29-1–29-3 and the NOR gates 28-1–28-3. The resulting data are delivered as the envelope data EB. In this way, the maximum value corresponding to the touch data as indicated in FIG. 6 is outputted.

A half adder HA, shift registers 17-1 and 17-2, NAND gates 18-1, 18-2 and 19-2, a NOR gate 19-1, and inverters 20 and 21 constitute a circuit which stores and generates the sounding status of the depressed key, namely, the status of attack, decay or release. The 8-bit shift registers 17-1 and 17-2 in this circuit are disposed for permitting the simultaneous generation of a plurality of sounds, likewise to the aforementioned 8-bit shift registers 16-1–16-9 for storing the envelope data. In this regard, the correspondence between the respective bits and the depressed keys for the sounds is established by the key assignor 2. The outputs of the shift registers 17-1, 17-2 are applied to the augend inputs $A_0$, $A_1$ of the half adder HA. and the sum outputs $S_0$, $S_1$ of the half adder HA are applied to the shift registers 17-1, 17-2 through the NOR gate 19-1 and the NAND gates 19-2, 18-1, 18-2, whereby a looped shift memory is constructed. The attack signal ATT, decay signal DC, release signal REL and preset signal PS are generated by the control circuit, not shown on the basis of the output signals of the shift registers 17-1, 17-2.

An AND gate 30, an OR gate 31 and an exclusive OR gate 32 constitute a gate circuit which changes the status of the status unit from the attack to the decay. This gate circuit applies the "H" level to the addition input of the half adder HA when the outputs of the shift registers have become the maximum value.

Figure 8:
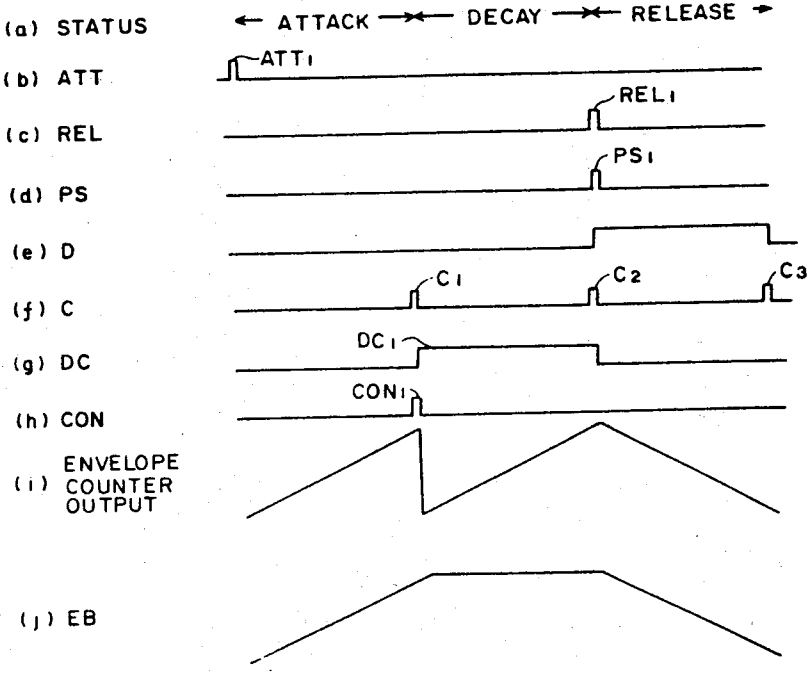
FIG. 8 is a time chart of the circuit shown in FIG. 7.

FIG. 8 is a timing chart of the envelope counter and status unit 4 shown in FIG. 7. (a) illustrates the status of the status unit; (b), (c), (d), (e), (f), (g) and (h) illustrate the attack signal ATT, release signal REL, preset signal PS, subtraction signal D, carry signal C, decay signal DC and control signal CON, respectively; (i) illustrates the envelope counter ouput; and (j) illustrates the envelope data EB.

Refering now to FIG. 8, the operations of the circuit shown in FIG. 7 will be described more in detail.

The depression of a key is detected by the key assignor 2. Further, a channel which is not used in the key assignor 2, namely, that register among the registers 16-1–16-9, 17-1 and 17-2 in FIG. 7 which is not used is selected, and an attack signal $ATT_1$ is received at the corresponding position of data rotating therein. In this condition, the "H" level and "L" level are respectively applied to the shift registers 17-1 and 17-2. In accordance with the attack signal $ATT_1$, the "H" level is applied to the NOR gates 23-1 to 23-6 and to the NOR gates 23-7 to 23-9 through the NOR gates 24-1 to 24-3. Therefore, the outputs of the NOR gates 23-1 to 23-9 become the "L" level and the "L" level is applied to all the bits of the shift registers 16-1–16-9. In other words, data in the corresponding channel positions of the shift registers are cleared. After the attack signal $ATT_1$ has been inputted, the data is incremented each time the clock signal E is inputted. This situation continues until the content reaches the maximum amplitude value appointed by the touch data. When the contents of the shift registers 16-1–16-9 have become equal to the aforementioned maximum amplitude value, the "H" level is provided from the AND gate 14, and it is passed through the AND gate 30 and OR gate 31 to apply a carry signal $C_1$ to the input $B_0$ of the half adder HA at the same timing as the clock E. This signal is also applied to the control circuit. When the control signal receives the carry signal $C_1$ in the attack status, it delivers a control signal $CON_1$ to render the contents of the shift registers 16-1–16-9 the "L" level. Owing to this signal, the status becomes the decay. That is, the contents of the half adder HA incremented bring the shift register 17-1 to the "L" level and the shift register 17-2 to the "H" level. Upon receiving these signals of the registers 17-1 and 17-2, the control circuit delivers a decay signal $DC_1$. In accordance with the decay signal $DC_1$, data in the shift registers 16-1–16-9 are not delivered, and the maximum amplitude value is delivered as the envelope data EB. More specifically, when the decay signal DC has become the "H" level as stated before, the outputs of the OR gates 26-1–26-6 become the "H" level, so that the lower 6 bits of the envelope data EB become the "H" level. In addition, the NOR gates 27-1–27-3 become the "L" level, and the AND gates 29-1–29-3 are turned "on" by the decay signal, so that the touch data a, b and c are inverted and then delivered through the NOR gates 28-1–28-3. This situation continues until the decay signal $DC_1$ becomes the "L" level. That is, it continues until a carry signal $C_2$ is outputted after the contents of the shift registers 16-1–16-9 have been cleared by the control signal $CON_1$ and incremented by the clock signal E again. The next status, namely, release status is established by the carry signal $C_2$. The decay signal $DC_1$ becomes the "L" level in a case where the depression of the key has been forcibly interrupted. At that time, the content of the envelope counter, namely, the contents of the shift registers 16-1–16-9 is/are equal to the maximum amplitude value.

In the state illustrated in the time chart of FIG. 8, the output of the exclusive OR gate 32 is the "L" level, and the AND gate 14 has detected the maximum amplitude value. Therefore, the carry signal $C_2$ is provided from the OR gate 31, and the content of the half adder HA is incremented, to establish the release status. Since both the shift registers 17-1 and 17-2 become the "H" level, the control circuit discriminates this state, to deliver a release signal $REL_1$ and also a preset signal $PS_1$. Further, since the full adder FA must be decrementally operated in the release status, the status unit provides the substraction signal D. The maximum amplitude value is set in the shift registers 16-1–16-9 by the preset signal $PS_1$.

Since the subtraction signal D is held at the "H" level till the delivery of the next carry signal $C_3$ from the OR gate 31, the contents of the registers 16-1–16-9 are decremented each time the clock E is inputted. Here, the carry signal $C_3$ is produced by the exclusive OR gate 32 and delivered from the OR gate 31 when the carry output $C_0$ of the full adder FA has become the "L" level.

Owing to the foregoing operations, the output of the envelope counter, namely, the data of the registers 16-1–16-9 become(s) a waveform shown at (i) in FIG. 8, and the envelope data EB becomes a waveform shown at (j).

Figure 9:
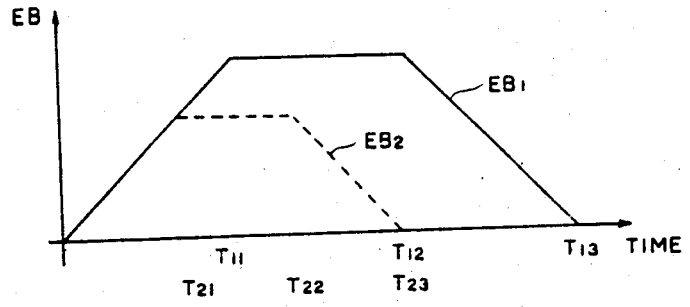
FIGS. 9, 10 and 13 are waveform diagrams of envelope data.

FIG. 9 illustrates the envelope data EB of the embodiment of the present invention shown in FIG. 7. By way of example, a solid line $EB_1$ indicates a case of the maximum value, and a broken line $EB_2$ a case of about $\frac{2}{3}$ of the maximum value. In the arrangement of FIG. 7, the periods of time of the attack, decay and release are proportional to the maximum amplitude value. When the envelope data $EB_1$ and those $EB_2$ are compared, the amplitude values have the relation of 3:2. In other words, the relation of (the maximum value of $EB_2$)÷(the maximum value of $EB_1$)$=\frac{2}{3}$ is held. This relation applies also to the time axis. More specifically, when the times of the ends of the attack, decay and release in the envelope data $EB_1$ are denoted by $T_{11}$, $T_{12}$ and $T_{13}$ and those in the envelope data $EB_2$ by $T_{21}$, $T_{22}$ and $T_{23}$, it holds that $T_{21} \div T_{11} = \frac{2}{3}$, $T_{22} \div T_{12} = \frac{2}{3}$ and $T_{23} \div T_{13} = \frac{2}{3}$. In addition, the respective periods of time of the attack, decay and release are equal.

Figure 10:
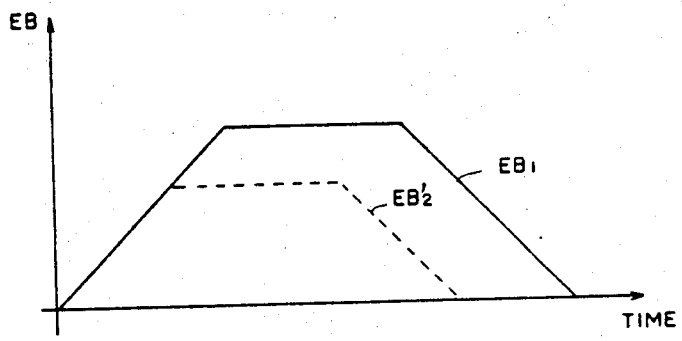

FIG. 10 shows the envelope data EB at the time at which the embodiment of the present invention in FIG. 7 has fallen into the decay status, under the condition that all the contents of the touch data a, b and c are the "L" level. Envelope data $EB_1$ have the maximum amplitude value, and those $EB_2'$ have an amplitude value of about $\frac{2}{3}$ of the maximum value. The periods of time of the attack and release are the same as in the embodiment illustrated in FIG. 9, but the period of time of the decay differs. Since all the touch data are held at the "L" level in only the decay status, the period of time of this status becomes constant irrespective of the maximum value.

Figure 11:
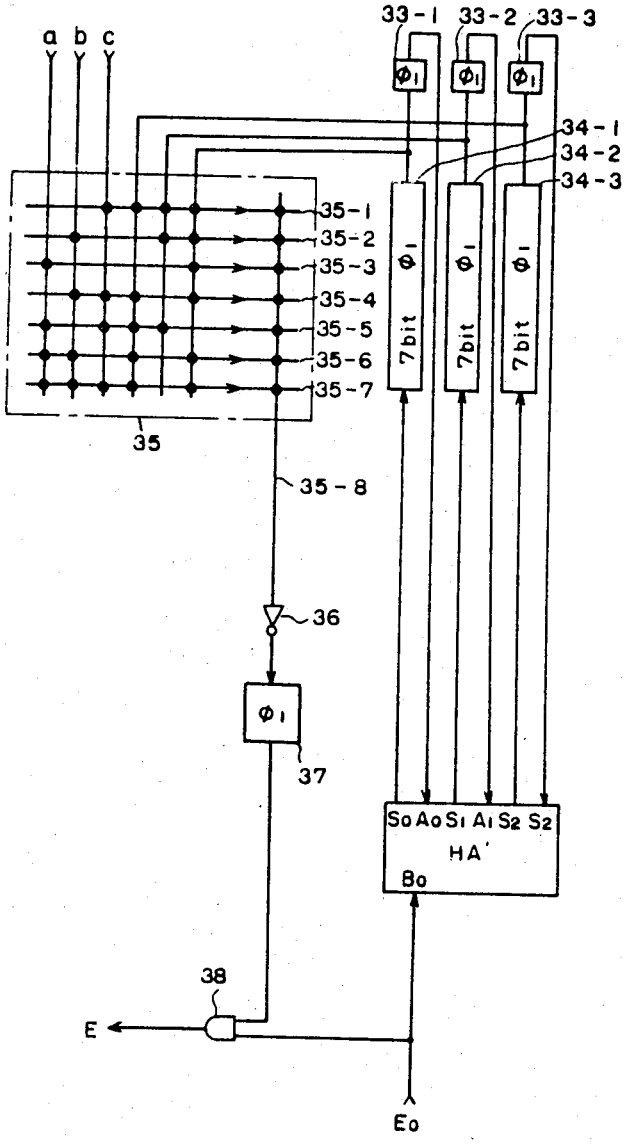
FIG. 11 is a circuit diagram of a touch control clock generator unit according to the present invention.

FIG. 11 is a circuit diagram of a touch control clock generator unit 10 in FIG. 1. In the foregoing, it has been assumed that the clock E is constant without depending upon the touch data a, b and c. In the embodiment in FIG. 11, this clock is varied in accordance with the touch data a, b and c. A basic clock $E_0$ is impressed on the addition input $B_0$ of a 3-bit half adder HA'. The outputs of registers 33-1, 33-2 and 33-3 are respectively applied to the augend inputs $A_0$, $A_1$ and $A_2$ of the half adder HA', and they have the basic clock added thereto. The outputs $S_0$, $S_1$ and $S_2$ of the half adder are respectively applied to 7-bit shift registers 34-1, 34-2 and 34-3, and they are respectively shifted by a clock $\phi 1$ to the applied to the registers 33-1, 33-2 and 33-3. The registers 33-1, 33-2, 33-3 and the shift registers 34-1, 34-2, 34-3 form looped shift registers of 8 bits, which correspond to the number of sounds to be simultaneously generated in the foregoing embodiment of FIG. 7. Data stored in these registers are respectively incremented by the half adder HA'. The values are incremented the same number of times in the attack, decay and release statuses, respectively.

The outputs of the 7-bit shift registers 34-1, 34-2 and 34-3 are also applied to a gate circuit 35. The gate circuit 35 also receives the touch data a, b and c. The gate circuit 35 constructs AND gates and OR gates in the shape of a matrix, and marks ○ denote the inputs of the AND gates, while marks ● denote the inputs of the OR gates. By way of example, when all the outputs of the shift registers 34-1, 34-2 and 34-3 are at the "H" level and the touch data c is at the "H" level, a line 35-1 becomes the "H" level and also a gate output 35-8 becomes the "H" level. Likewise, when the touch data b and the outputs of the shift registers 34-1 and 34-2 are at the "H" level, a line 35-2 becomes the "H" level, and the output 35-8 becomes the "H" level accordingly. The output 35-8 is inverted by an inverter 36, and then connected to the first input of an AND gate 38 through a register 37. The basic clock $E_0$ is applied to the second input of the AND gate 38 from the envelope clock generator unit 11. As a result, when the output 35-8 of the gate circuit 35 is the "H" level, the AND gate 38 turns "off", and the basic clock $E_0$ is not outputted. In other words, the basic clock $E_0$ is not delivered with some values of the outputs of the shift registers 34-1, 34-2, 34-3 and the touch data. Clock pulses thus thinned out are used as a clock E, whereby the envelope data can be put into a waveform different from that in FIGS. 9 or 10.

Figures 12, 13:
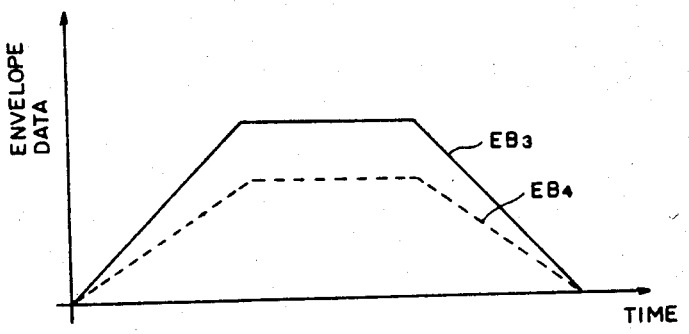
FIG. 12 indicates the relationship of touch data and output clocks.

FIG. 12 lists the values of the registers 34-1, 34-2 and 34-3 in the cases where the clock pulses $E_0$ are thinned out by the gate circuit 35. Here, "1" and "0" indicated the "H" level and "L" level respectively, and marks ○ indicate the thinned-out conditions. By way of example, when all the touch data are the "H" level, the clock $E_0$ is delivered only in the state in which all the outputs of the shift registers 34-1, 34-2 and 34-3 are the "L" level, and it is not delivered in any other state. The number of the clock pulses decreases in proportion to the touch data a, b and c.

FIG. 13 is a waveform diagram showing the envelope data EB in the embodiment of FIG. 11. Since, as indicated in FIG. 12, the thinning-out of the basic clock $E_0$ is proportional to the value of the touch data a, b and c, the periods of time of the attack, decay and release become constant irrespective of the maximum value. Thus, these periods of time are fixed irrespective of the maximum values of envelope data $EB_3$ and $EB_4$.

According to the construction of the present invention thus far described with reference to FIGS. 6 to 13, the envelope waveform corresponding to the touch data or the speed of the depressed key can be attained with simple circuitry. Further, it is possible to obtain both the envelope waveform whose amplitude value and period of time are proportional to the touch data, and the envelope waveform in which only the amplitude value is proportional to the touch data and the period of time is fixed irrespective of the touch data.

While, in the foregoing embodiments, the touch data consisted of 3 bits, a larger number of sorts of maximum values of the envelope data can be obtained by increasing the number of bits of the touch data. Further, while the basic clock has been fixed, it is also allowed to vary in correspondence with the respective statuses of attack, decay and release.

Figure 14:
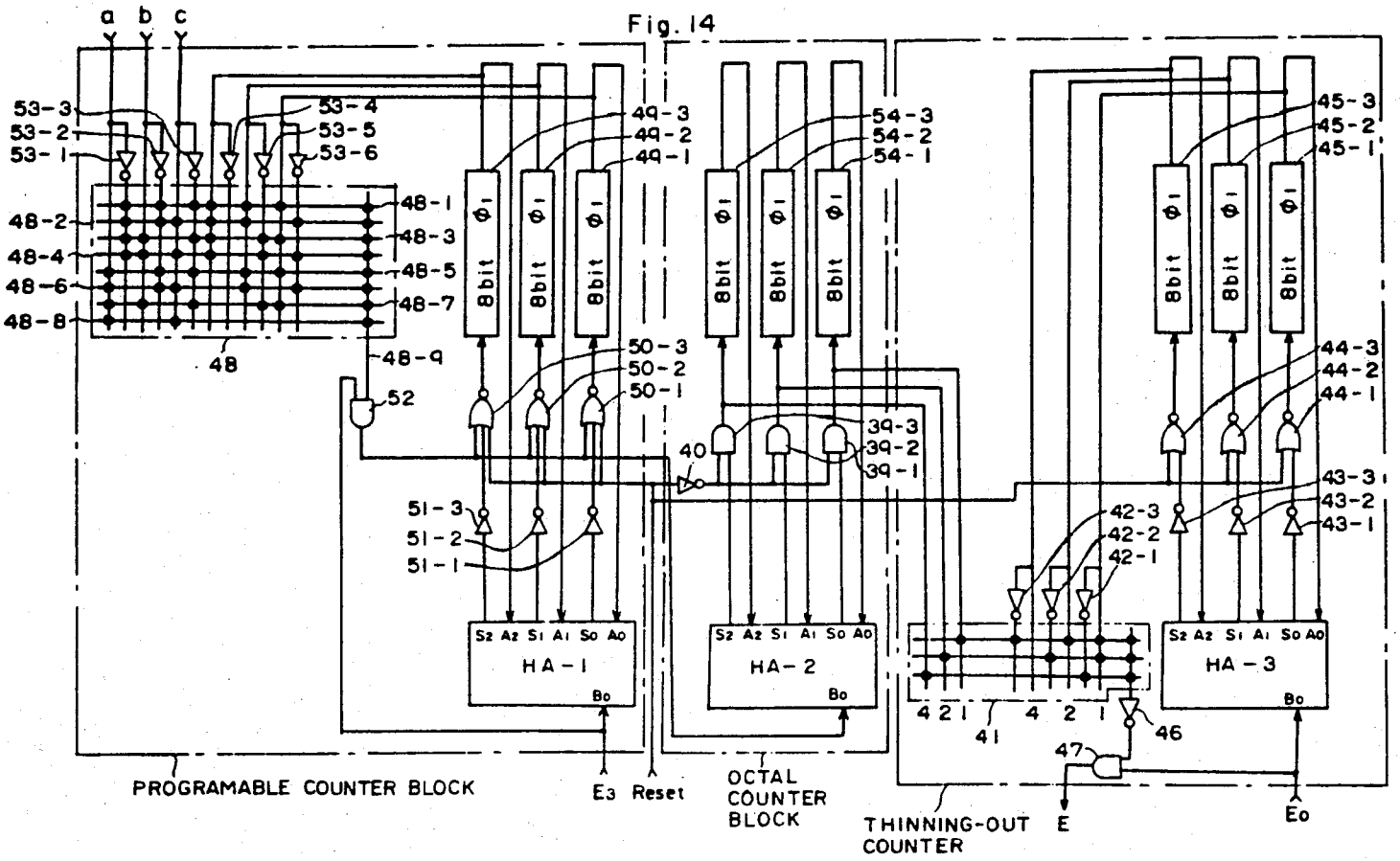
FIG. 14 is a circuit diagram showing another embodiment of the touch control clock generator unit of the present invention.

FIG. 14 shows another embodiment of the touch control clock generator unit 10 in the system setup of the electronic musical instrument shown in FIG. 1. In this embodiment, the unit is divided into a programable counter portion, an octal counter portion and a thinning-out counter portion.

The programable counter portion is composed of a gate circuit 48, 8-bit shift registers 49-1 to 49-3, a half adder HA-1, NOR gates 50-1 to 50-3, inverters 51-1 to 51-3 and 53-1 to 53-6, and an AND gate 52. The programable counter portion has its scale of notation changed depending upon the touch data a, b and c. In other words, it generates clocks of frequencies corresponding to the touch data.

The gate circuit 48 and the inverters 53-1–53-6 have the logic function of deciding whether or not a clock $E_3$ is delivered through the AND gate 52, from the touch data a, b, c and the contents of the shift registers 49-1–49-3. For example, when the touch data a, b and c are respectively at "L", "L" and "H" levels, the "H" level is applied to the AND gate 52 subject to the condition that the contents of the shift registers 49-3, 49-2 and 49-1 are respectively "H", "H" and "L" levels. The gate circuit 48 has a matrix structure, the AND gates of which have their outputs functionally denoted by horizontal lines 48-1 to 48-8 and the OR gates of which provides an output functionally indicated by a vertical line 48-9.

The "H" level is applied from the gate circuit 48 to the AND gate 52 in correspondence with the touch data a, b, c and the contents of the registers 49-3–49-1. The clock $E_3$ is also applied to the AND gate 52. As a result, the AND gate 52 provides the clock $E_3$ only when the output of the gate circuit 48 has become the "H" level. Upon the delivery of the clock $E_3$ through the AND gate 52, the NOR gates 50-1–50-3 provide their outputs of the "L" level. Thus, the registers 49-1–49-3 receive the "L" level, and their data till then are erased, so that they are reset. When the output of the AND gate 52 is the "L" level, the output of the AND gate 52 becomes the "L" level. Since this output is applied to the NOR gates 50-1–50-3, these NOR gates supply the registers 49-1–49-3 with data which the sum outputs $S_0$–$S_2$ of the half adder HA-1 have sent through the inverters 51-1–51-3. The clock $E_3$ is outputted from the AND gate 52 once in 8 clocks when the touch data a, b, and c are all at the "L" level; once in 7 clocks when they are at the "L", "L" and "H" levels; once in 6 clocks when they are at the "L", "H" and "L" levels; and once in 5 clocks when they are at the "L", "H" and "H" levels. In addition, the clock $E_3$ is outputted from the AND gate 52 once in 4 clocks, 3 clocks, 2 clocks and 1 clock when the touch data a, b and c are at the "H", "L" and "L" levels, the "H", "L" and "H" levels, the "H", "H" and "L" levels and the "H", "H" and "H" levels, respectively. In other words, the programable counter portion has the function of dividing the frequency of the clock pulse $E_3$ in correspondence with the touch data a, b and c. The data of the registers 49-1 to 49-3 are brought to the "L" level by a reset signal. The varying speed of the envelope is controlled by frequency division.

The octal counter portion comprises shift registers 54-1, 54-2 and 54-3, a half adder HA-2, AND gates 39-1, 39-2 and 39-3, and an inverter 40. This octal counter portion counts steps to be described later in the attack and release statuses, and informs the thinning-out counter portion of the data designating Nos. of the steps. The half adder HA-2 adds a summand input $B_0$ and augend inputs $A_0$–$A_2$, and its outputs $S_0$–$S_2$ are applied to the 8-bit shift registers 54-1–54-3 through the AND gates 39-1–39-3. Thus, save when the reset signal has been received, the octal counter portion counts the clock pulses obtained from the programable counter portion.

In this embodiment of the present invention, the amplitude of the envelope waveform is in an amplitude direction divided into eight steps in correspondence with the touch data, and the slopes of the envelope waveform are determined by the respective steps. The octal counter portion counts No. of the envelope waveform.

The thinning-out counter portion comprises a gate circuit 41, a half adder HA-3, inverters 42-1 to 42-3 and 43-1 to 43-3, NOR gates 44-1 to 44-3, 8-bit shift registers 45-1 to 45-3, an inverter 46, and an AND gate 47. The basic clock $E_0$ is applied to the summand input $B_0$ of the half adder HA-3, and the outputs of the shift registers 45-1–45-3 are applied to the augend inputs $A_0$–$A_2$ thereof. The sum outputs $S_0$–$S_2$ of the half adder HA-3 are applied to the 8-bit shift registers 45-1–45-3 through the inverters 43-1–43-3 and NOR gates 44-1–44-3. The outputs of the 8-bit shift registers 45-1–45-3 enter the gate circuit 41 through the inverters 42-1–42-3. The output of the gate circuit 41 is applied to the AND gate 47 through the inverter 46. The basic clock $E_0$ is also applied to the AND gate 47. The 8-bit shift registers 45-1–45-3 and the half adder HA-3 constitute an incremental counter, which is successively incremented by the basic clock pulses $E_0$.

Except when the reset signal has been inputted, the "H" level is delivered from the gate circuit 41 in correspondence with the contents of the shift registers 45-1–45-3 and the 3-bit outputs from the octal counter portion, and it is passed through the inverter 46 to turn "off" the AND gate 47. When the AND gate 47 is "off" the basic clock $E_0$ is not delivered.

Similarly to the foregoing gate circuit 48, the gate circuit 41 has a matrix structure, in which marks ○ denote the inputs of AND gates and marks ● denote the inputs of OR gates.

Figures 15, 16:
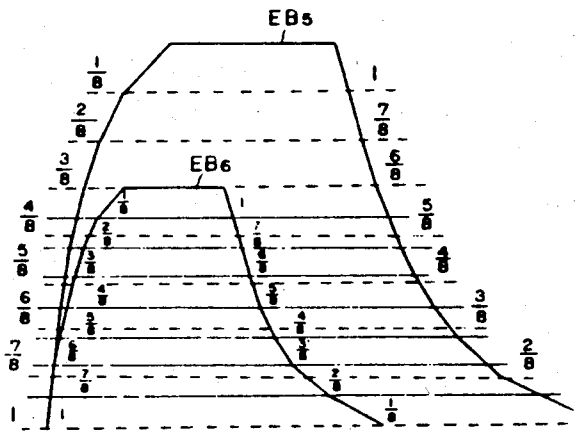
FIG. 15 indicates timings at which no clock is delivered, in relation to octal counter outputs.
FIG. 16 shows waveforms produced by the embodiment of FIG. 14.

FIG. 15 is a diagram indicating the clock output statuses of the thinning-out counter. Marks ○ indicate the condition under which the basic clock $E_0$ is not delivered. When all the outputs of the octal counter portion are at the "L" level ("0" in FIG. 15 corresponds to the "L" level, and "1" to the "H" level), the respective clocks are outputted, and when all the outputs of the octal counter portion are at the "H" level, one output is provided in 8 clocks. As another example, when the octal counter outputs are at the "L", "L" and "H" levels, one output is prevented in 8 clocks.

As a result, as the output value of the octal counter portion becomes larger, a larger number of clocks are not delivered. This signifies that the incremental or decremental operation of the envelope counter becomes slower. That is, as the output of the octal counter portion becomes larger, the output of the envelope counter increases or decreases more slowly.

FIG. 16 shows an envelope waveform according to the embodiments of FIGS. 7 and 14. An envelope waveform $EB_5$ corresponds to a case where all the touch data a, b and c are at the "L" level, and an envelope waveform $EB_6$ a case where the touch data a, b and c are at the "L", "H" and "H" levels. As seen from FIG. 16, the slopes of each waveform become gentle in correspondence with the amplitude values divided into eight step. In addition, the slopes of the attack and those of the release are reversed. This is one characterizing feature of the present invention, and has been achieved by storing a step number of the attack status and release status by means of the octal counter portion. The waveforms change exponentially.

In the embodiment of FIG. 14, the same basic clock $E_0$ has been used for all the statuses of attack, decay and release. Thus, the periods of time of the attack, decay and release statuses equalize. These periods of time can be rendered unequal by changing the basic clock in correspondence with the attack, decay and release statuses as in FIG. 11. In this case, the frequency of the basic clock pulses $E_0$ may be controlled by supplying the outputs of the shift registers 17-1, 17-2 in FIG. 7 to the envelope clock generator unit 11.

According to the construction thus far described in detail with reference to FIG. 7 and FIGS. 14 to 16, an envelope waveform corresponding to a key touch can be digitally produced with simple circuitry, and the waveform changes exponentially. Therefore, it becomes possible to provide an electronic musical instrument which generates sounds that are close to actual musical sounds given forth from a musical instrument.

What is claimed is:

1. A touch response apparatus for an electronic musical instrument having a keyboard, comprising, touch data generating means for generating touch data as a function of a key depression status of an operated key of said keyboard;

envelope generating means for generating envelope data corresponding to an envelope, said envelope generating means including means for counting up to a level data corresponding to each said touch data generated by said touch data generating means in an attack status of the operated key, and means for counting down from said level data in a release status of the operated key;

said envelope generating means including:

setting means for establishing a reached value of a count value of said counting up means in accordance with said touch data generated by said touch data generating means;

relative value data generating means for generating a relative value data of a present value data of said envelope data generated by said counting up means and counting down means relative to said reached value data; and count rate control means for controlling a count rate of said counting up means and counting down means in accordance with said relative value data generated by said relative value data generating means; and control means coupled to said envelope generating means and to said touch data generating means for comparing the envelope data with said touch data so as to change the count status of said envelope generating means according to the comparing result.

2. The touch response apparatus of claim 1, wherein said envelope generating means further includes means for generating said level data in a sustaining status of the operated key.

3. The touch response apparatus of claim 1, further comprising a basic clock generator; and wherein said count rate control means includes means for dividing a frequency of a basic clock generated from said basic clock generator in accordance with said relative value data and for supplying a frequency divided clock signal to said counting up means and counting down means.

4. A touch response apparatus for an electronic musical treatment having keyboard, comprising;

touch data generating means for generating touch data as a function of a key depression status of an operated key of said keyboard;

envelope generating means for generating envelope data corresponding to an envelope, said envelope generating means including means for counting up to a level data corresponding to each said touch data generated by said touch data generating means in an attack status of the operated key, and means for counting down from said level data in a release status of the operated key;

said envelope generating means including:

setting means for establishing a maximum value value of said envelope data generated by said envelope data generating means in accordance with said touch data generated by said touch data generating means, dividing means for dividing an envelope into a predetermined number of steps in an amplitude direction in accordance with said maximum value established by said setting means and for detecting the arrival of said envelope data generated by said counting up means and counting down means at respective steps, and changing means for changing a manner of generating said envelope data from said counting up means and counting down means when said dividing means detects said arrival of said envelope data; and control means coupled to said envelope generating means and to said touch data generating means for comparing the envelope data with said touch data so as to change the status of said envelope counting means according to the comparing result.

5. The touch response apparatus of claim 4, wherein said envelope generating means further includes means for generating said level data in a sustaining status of the operated key.

6. A touch response apparatus for an electronic musical instrument having a keyboard with a plurality of keys, comprising:

touch data generating means for generating touch data as a function of a key depression status of an operated key of said keyboard;

envelope generating means for generating envelope data corresponding to an envelope, said envelope generating means including means for counting up to a level data corresponding to each said touch data generated by said touch data generating means in an attack status of the operated key, and means for counting down from said level data in a release status of the operated key;

control means coupled to said envelope generating means and to said touch data generating means for comparing the envelope data with said touch data so as to change the status of said envelope counting means according to the comparing result; and key assigning means:

said touch data generating means including a key touch detecting and holding circuit provided for each key of the keyboard;

each of said key touch detecting and hold circuits comprising at least one charging circuit including a capacitor; at least one discharging circuit for discharging electric charge stored in said capacitor in relation with a touch status of the generated key; and at least one switch means for providing a signal representing a key "on" status of the key to said key assigning means; and said touch data generating means further including a plurality of gate circuit respectively connected to said key touch detecting and holding circuit, and operating in accordance with a signal from said key assigning means; and an analog-to-digital converter circuit to which the outputs of the respective gate circuits are commonly connected, for converting the voltage of said capacitor to a digital value to thereby produce said touch data representing the touch status of the operated key.

7. The touch response apparatus of claim 6, wherein said envelope generating means further includes means for generating said level data in a sustaining status of the operated key.

* * * * *